US007096767B2

(12) United States Patent
Sherburne

(10) Patent No.: US 7,096,767 B2
(45) Date of Patent: Aug. 29, 2006

(54) ADJUSTABLE WRENCH

(76) Inventor: Hollis B. Sherburne, 6670 Green River Dr., Unit E, Highlands Ranch, CO (US) 80130

( * ) Notice: Subject to any disclaimer, the term of this patent is extended or adjusted under 35 U.S.C. 154(b) by 0 days.

(21) Appl. No.: 10/711,876

(22) Filed: Oct. 11, 2004

(65) Prior Publication Data

US 2006/0075853 A1 Apr. 13, 2006

(51) Int. Cl.
*B25B 13/22* (2006.01)

(52) U.S. Cl. ..... 81/145; 81/146; 81/147

(58) Field of Classification Search ..... 81/145, 81/146, 147, 148, 149, 385, 129, 134, 138, 81/143

See application file for complete search history.

(56) References Cited

U.S. PATENT DOCUMENTS

| | | | | | |
|---|---|---|---|---|---|
| 620,785 | A * | 3/1899 | Klatt | 81/126 |
| 0,620,785 | A | 3/1899 | Klatt | |
| 1,053,181 | A * | 2/1913 | Iring | 81/129.5 |
| 1,157,383 | A * | 10/1915 | Hakey | 81/128 |
| 1,317,546 | A * | 9/1919 | Bryant | 81/144 |
| 1,397,214 | A * | 11/1921 | Hose | 81/151 |
| 1,468,211 | A * | 9/1923 | Quist | 81/126 |
| 1,501,214 | A | 7/1924 | Garrison | |
| 1,523,093 | A * | 1/1925 | Wilcox | 81/145 |
| 1,792,338 | A * | 2/1931 | Walz | 81/145 |
| 2,296,604 | A * | 9/1942 | Fella | 81/106 |
| 2,724,301 | A | 11/1955 | Parent et al. | 81/145 |
| 2,948,175 | A * | 8/1960 | Bonkowski | 81/154 |
| 3,232,150 | A * | 2/1966 | Ailegraud | 81/143 |
| 3,803,954 | A * | 4/1974 | Lenker | 81/126 |
| 4,214,491 | A * | 7/1980 | Martinmaas | 81/134 |
| 4,454,791 | A * | 6/1984 | Seward, III | 81/133 |
| 4,735,121 | A * | 4/1988 | Coulson | 81/129 |
| 5,103,697 | A * | 4/1992 | Masbaum | 81/154 |
| 5,152,198 | A * | 10/1992 | Schmitz, Jr. | 81/145 |
| 5,375,490 | A * | 12/1994 | Carlmark | 81/133 |
| 6,799,493 | B1 * | 10/2004 | Wang | 81/135 |
| 2002/0112574 | A1 * | 8/2002 | Marks | 81/165 |

* cited by examiner

*Primary Examiner*—David B. Thomas
*Assistant Examiner*—Robert Scruggs
(74) *Attorney, Agent, or Firm*—Roger A. Jackson

(57) ABSTRACT

An adjustable wrench and method for loosening or tightening a fastener includes a handle member having a fixed jaw segment, a substantially transverse channel therethrough, and a void in communication with the channel. Also, a movable jaw member having a serrated toothed rack that is slidably engaged within the channel. In addition, a beam that is slidably engaged within the void, the beam including a toothed rack that selectably matably engages with the movable jaw toothed rack to help secure the jaw in position. Finally, included is a trigger member that is pivotally attached to the movable jaw member and is slidably engaged with the handle member, the trigger facilitates manual movement of the movable jaw from the closed state to the open state and vice versa, when the movable jaw toothed rack and the beam toothed rack are selectively disengaged.

25 Claims, 5 Drawing Sheets

ADJUSTABLE WRENCH

TECHNICAL FIELD

The present invention relates generally to adjustable wrenches. More particularly, the present invention relates specifically to manually hand operated adjustable wrenches having variable jaw adjustment within a range, for use with a particular size fastener, wherein the wrench jaw is activated to close down and secure upon the fastener for tightening or loosening of the fastener until the adjustable jaw is manually unsecured.

BACKGROUND OF INVENTION

Manually hand operated adjustable wrenches having variable jaw adjustment within a range, for use with a particular size fastener are old in the art. The most traditional type is typically called a crescent wrench. The design of a crescent wrench includes a movable jaw slide and a guide track that is opposed to a fixed jaw, wherein the movable jaw is adjusted by means of a worm gear that is supported within the housing that forms an end portion of the adjustable wrench handle. Typically, the worm gear functions as a thumb wheel, wherein rotating the worm gear causes the jaw to move toward and away from the fixed jaw. One issue with the crescent wrench is the speed of adjustment that is attainable, thus to have a higher speed of adjustment with the worm gear and thumb wheel would require a steeper helical angle to be constructed for the cut of the worm gear, however, this steeper angle decreases the ability of the movable jaw to reliably hold a secure position upon the fastener, especially when the fastener is under a high level of force as against movable jaw, in effect causing the worm gear to rotate in a manner to loosen or in other words drive the two jaw faces apart. This results in causing the problem of rounding off of the fastener points which is undesirable and can also cause injury to the user's hand, in that as the wrench slips around the points of the fastener while the user is applying force to the end of the handle furthest from the jaws can result in scraped and cut knuckles. As a practical matter, the steepness of the helical angle of the thumb driven worm gear is about 30 degrees off of a perpendicular axis of rotation for the worm gear.

Another drawback of the typical traditional crescent wrench, is that in order to adjust the jaws relative to one another the user's hand must move from its advantageous position on the handle which is at the furthest distance from the jaw portion of the handle that results in maximum torque applied from the force of the user's hand, wherein the users hand to adjust the jaws relative to one another must be moved toward the jaw portion of the handle for the user's fingers to engage the worm gear to facilitate jaw adjustment. This requirement of the user having to move their hand on the handle of the wrench can be especially inconvenient when the wrench is being used in a tight or confined space around the fastener. Thus, the aforementioned description of a typical crescent wrench has identified three major problems, the first problem being the slow speed of adjustment between the jaws, the second problem being the inconvenience of the user having to reposition their hand on the handle to make the jaw adjustment, and the third problem being the lack of a secure holding of a position of the movable jaw especially while under load from the function of tightening or loosening the fastener causing not only damage to the fastener itself but also potential injury to the user's hand. These three problems have been well recognized in the prior art and the following is a partial summary of some of the solutions that have been put forward in the prior art of manually hand operated adjustable wrenches. One type of adjustable wrench in the prior art utilizes a serrated tooth rack, wherein a pair of separated tooth racks matably engage with one rack on the movable jaw segment and another rack on a spring loaded plunger, wherein the spring urges the racks to matably engage thus securing the movable jaw segment in a particular position relative to the fixed jaw segment. To move the movable jaw segment the plunger is manually pulled back against its urging to disengage the tooth racks, thus allowing the movable jaw segment to freely move.

One example is given in U.S. Pat. No. 1,501,214 to Garrison that discloses a sliding jaw wrench wherein the lower jaw is movable and lockable against an acute angle serrated tooth rack interface with a mating serrated rod or plunger. In Garrison the rod is selectively manually moved by a thumb piece to allow free adjustment of the movable jaw segment, and when in use the user must manually close the immovable jaw segment against the fastener and then simultaneously release the rod for the serrated toothed rack interface to engage thus locking the movable jaw in a secure position. Although Garrison overcomes the problem of the movable jaw not being securely locked in position by virtue of the toothed rack interface, there is a problem in that the movable jaw must be manually positioned by the user's second hand as against the fastener while the users first hand must manually hold the rod away from the movable jaw segment at the same time, this can be especially difficult in tight or confined areas around the fastener. Another prior art example is in U.S. Pat. No. 2,724,301 to Parent et al. that discloses a sliding jaw wrench wherein the lower jaw is movable and lockable against an acute angle serrated rack interface with a mating serrated block that has a rack interface similar to Garrison in structure and function, with the exception that the block axially slides on a pin transverse to the jaw faces.

Also, U.S. Pat. No. 5,152,198 to Schmitz, Jr., disclosed is a snap lock adjustable wrench that utilizes a spring to urge the movable jaw closed and is otherwise similar to Garrison in having an acute angle serrated rack interface between the jaw and the rod, one additional feature is an axially locking threaded knob on the rod to compress the serrated rack interface. Again, U.S. Pat. No. 1,523,093 to Wilcox, disclosed is an adjustable sliding jaw wrench that is similar to Garrison in structure and function with the exception of the spring loaded rod being shorter and having two sandwich plates that have their respective serrated racks offset or staggered which is to allow a finer adjustment of the movable jaw. Further, in U.S. Pat. No. 1,053,181 to Iring, disclosed is an adjustable wrench utilizing a movable lower jaw with a serrated rack, however, being matably engaged with a parallel positioned serrated rack bar that is mounted on a spring loaded pivot, thus the bar must be manually disengaged by one hand while the movable jaw is selectably positioned by the other hand as in the other prior art examples given in this paragraph. A final prior art example in this area is in U.S. Pat. No. 1,397,214 to Hose the discloses a wrench with a mating acute angle serrated rack similar to Wilcox except for the spring loaded rod not being two pieces and the rack being inclined slightly with the stated purpose to allow for a more firm engagement of the mating rack when the jaws are loaded from tightening or loosening of the fastener, in addition the incline acts to allow easier sliding of the mating racks for pushing the movable jaw closed with set screws that can further hold the rod axially.

None of the aforementioned prior examples address the problem of the speed with which the movable jaw can be placed into its selected position and all require the use of two hands to both manually disengage the rod serrated tooth interface from the movable jaw serrated tooth interface and at the same time requiring the user to manually move the movable jaw into the selected position, consuming both of the user's hands at the same time and causing difficulty where there is a tight or confined space around the fastener.

Other prior art approaches to the manually adjustable wrench have a higher degree of complexity such as in U.S. Patent Application Publication No. U.S. 2002/0112574 A1 to Marks that discloses a slide switch adjustable wrench, allowing through a mechanical linkage adjustment of the movable jaw from the handle portion opposite of the jaw portion thus overcoming the two hands required problem as previously discussed and assisting in the speed of adjustment issue of the movable jaw, however, as Marks still uses the helical thumb wheel to adjust the movable jaw there's still the aforementioned issue of the movable jaw not being secured in a selected position as against the fastener. Another solution is given in U.S. Pat. No. 5,375,490 to Carlmark that utilizes an adjustable spanner having a crescent gear segment meshed with a toothed rack on the movable jaw with the disadvantage being, of having to initiate a separate locking device to fix the movable jaw position.

Also, in U.S. Pat. No. 4,454,791 to Seward, III utilized is a geared thumb wheel that mates with a rack gear on the movable jaw, being similar to Carlmark in requiring a separate selectable lock to engage the rack gear of the movable jaw to secure the movable jaw's position. Further, in U.S. Pat. No. 3,803,954 to Lenker, a pivoted handle is used having a pinion that engages the toothed rack movable jaw not having any auxiliary device for locking the movable jaw into a selected position other than the force exerted on the pinion that is that the end portion of the handle upon the movable jaw rack. Finally, in U.S. Pat. No. 1,317,546 to Bryant disclosed is an adjustable wrench with a spring loaded thumb pivot that engages and disengages a serrated rack from a slide bolt for locking the movable jaw into a spring loaded position from a lever with the thumb pivot also acting to open the movable jaw by an arm against the lever when the slide bolt is disengaged from the serrated rack operating through a complex linkage, which does allow one-handed operation for setting and locking the movable jaw, however, the adjustable wrench must be held near the jaw portion and not the handle end portion that opposes the jaw for proper and efficient use as previously described.

What is needed is an adjustable wrench for manual use that only requires one hand operation from the user with the user's hand positioned in its normal location on the wrench handle which is on the end portion opposite of the wrench jaw portion, thus to allow the wrench jaws to be positioned in tight or confined spaces around the fastener and for a way to quickly and easily set the movable jaw into the selected position and have the movable jaw securely locked into the selected position, thus having the added benefit of one handed ratcheting of the fastener.

SUMMARY OF INVENTION

Broadly, the present invention of an adjustable wrench assembly for loosening or tightening a fastener includes a handle member having a longitudinal axis spanning between a handle first end portion, a handle central portion, and a handle second end portion. The handle first end portion including a fixed jaw segment, a fixed jaw surface plane, and a transverse axis to the fixed jaw surface plane. The handle first end portion also includes a channel therethrough positioned substantially parallel to the transverse axis, with the handle central portion including a void in communication with the channel, with the void also having a longitudinal axis. Also included is a movable jaw member including a jaw segment, a jaw surface plane, and an engagement portion. The engagement portion is slidably engaged within the channel being operational to move the movable jaw member from an open state to a closed state and from the closed state to the open state. The movable jaw member also includes a serrated toothed rack whose pitch line forms an acute angle in relation to the movable jaw surface plane.

In addition, included in the adjustable wrench assembly is a beam that has a longitudinal axis, the beam is slidably engaged for reciprocative movement within the void. The beam includes an end portion capable of projecting into the channel, the beam end portion having a serrated toothed rack that selectably matably engages with the movable jaw member serrated toothed rack to help secure the movable jaw member against movement between the closed state and the open state. Finally, included is a trigger member that is pivotally attached to the movable jaw member and is slidably engaged to the handle member. Wherein the trigger is operational to facilitate manual movement of the movable jaw member from the closed state to the open state and from the open state to the closed state when the movable jaw member serrated toothed rack and the beam serrated toothed rack are selectively disengaged.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
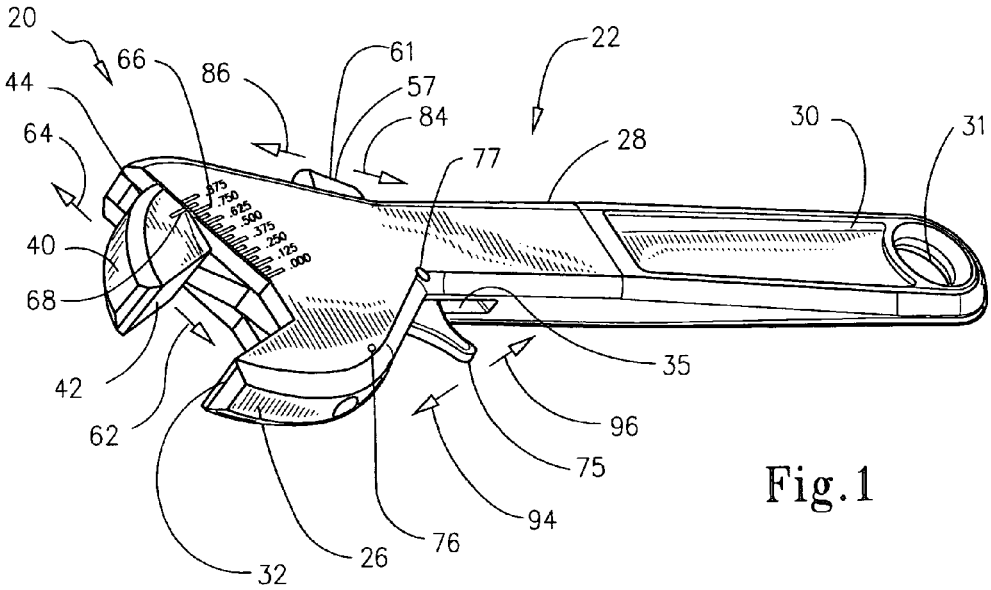
FIG. 1 shows a perspective view of the adjustable wrench assembly with the movable jaw member moved toward the open state.

20 Adjustable Wrench Assembly
22 Handle member
24 Handle longitudinal axis
26 Handle first end portion
28 Handle central portion
29 Handle central portion first aperture
30 Handle second end portion
31 Handle second end portion aperture
32 Handle fixed jaw segment
33 Handle fixed jaw segment jaw surface plane
34 Fixed jaw surface plane transverse axis
35 Handle central portion second aperture
36 Handle first end portion channel therethrough
37 Handle first end portion channel recess
38 Handle central portion void
49 Handle central portion void longitudinal axis
40 Movable jaw member
41 Movable jaw member slot void
42 Movable jaw member jaw segment
43 Movable jaw member jaw surface plane
44 Movable jaw member engagement portion
45 Movable jaw member rib portion
46 Movable jaw member serrated toothed rack
47 Means for urging movable jaw member into the open state
48 Movable jaw member spring element
49 Serrated toothed rack pitch line
50 Serrated toothed rack pitch line acute angle
51 Movable jaw member aperture
52 Beam
53 Beam longitudinal axis
54 Beam serrated toothed rack end portion
55 Beam non toothed end portion
56 Beam serrated toothed rack
57 Beam extension
58 Beam aperture
59 Means for urging beam serrated toothed rack 56 to matably engage with movable jaw member serrated toothed rack 46
60 Beam spring element
61 Means for manually selectively disengaging the beam serrated toothed rack from the movable jaw member serrated toothed rack
62 Direction of movable jaw member movement toward the closed state
64 Direction of movable jaw member movement toward the open state
65 Beam extension pin
66 Handle fixed jaw segment indicia
68 Movable jaw member indicia
70 Support member
71 Support element
75 Trigger member
76 Movable jaw member spring element retention pin
77 Trigger slot pin
78 Movable jaw member spring element retention pin aperture
79 Trigger pivot pin
80 Fixed jaw segment surface plane angle to handle longitudinal axis
81 Trigger slot
82 Movable jaw member surface plane angle to handle longitudinal axis
83 Trigger pivot aperture
84 Opening portion of the reciprocative movement of the beam
85 Trigger slot pin aperture
86 Closing portion of the reciprocative movement of the beam
87 Trigger finger grip
88 Movable jaw member void
89 Trigger extension insert
90 Movable jaw member pin clearance
91 Trigger body
94 Trigger movement for movable jaw member movement toward the open state
96 Trigger movement for movable jaw member movement toward the closed state
98 Beam longitudinal axis angle to handle longitudinal axis
102 Beam extension thumb grip
104 Movable jaw opening force
106 Reactionary force that is substantially equal and opposite of movable jaw opening force 104
109 Beam serrated tooth step
110 Serrated tooth face to step angle
112 Serrated tooth rack pitch line angle to beam longitudinal axis
113 Beam serrated tooth face
114 Serrated tooth face height
116 Serrated tooth face angle to pitch line
118 Serrated tooth step angle to pitch line
120 Movable jaw member serrated tooth step
122 Movable jaw member serrated tooth face
124 Serrated toothed rack width

DETAILED DESCRIPTION

Figure 2:
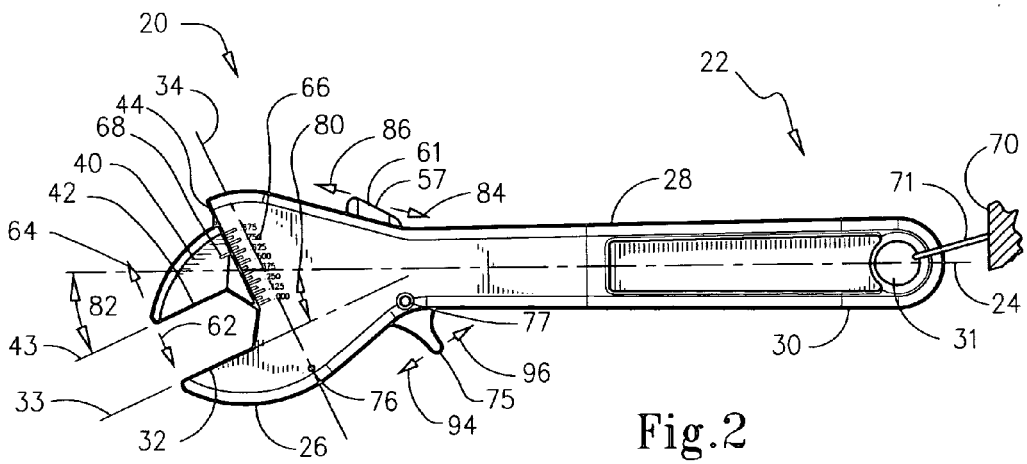
FIG. 2 shows a side view of the adjustable wrench assembly with the movable jaw member moved toward the open state, with the wrench suspended from a support member through use of a suspension element.
Figure 3:
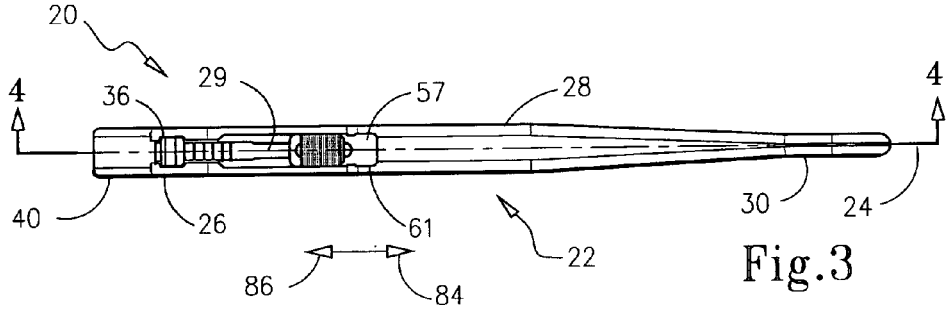
FIG. 3 shows a view of the adjustable wrench assembly from the movable jaw member end.
Figure 4:
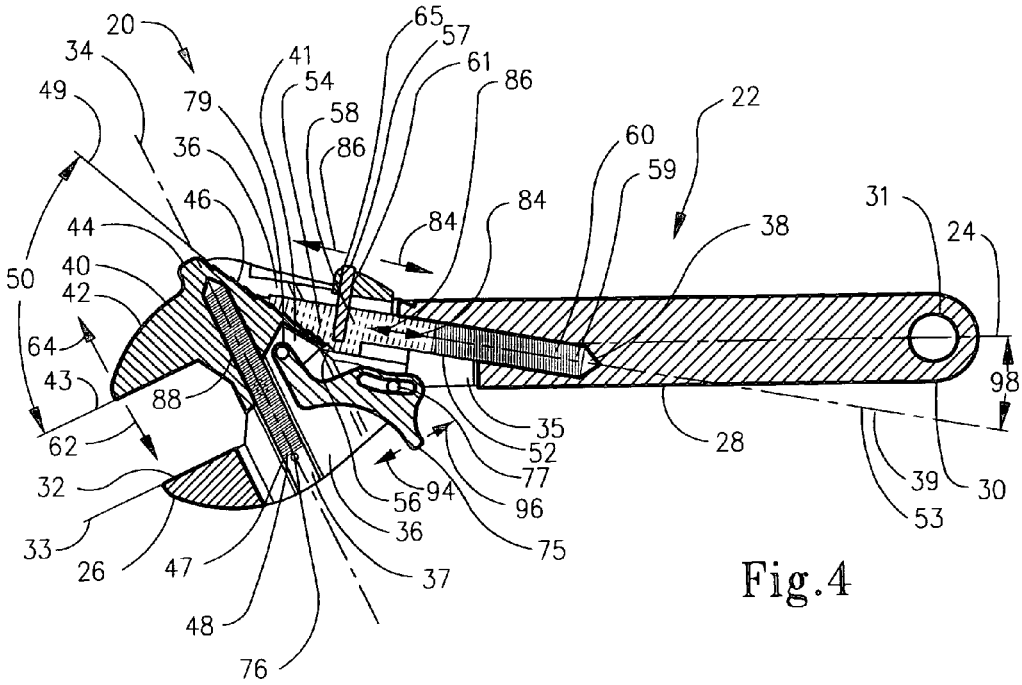
FIG. 4 shows crossectional cut 4—4 from FIG. 3, depicting the broad general interface between the movable jaw member, the beam, the trigger, and the handle member along with the means for urging the beam and the means for urging the movable jaw member.
Figure 5:
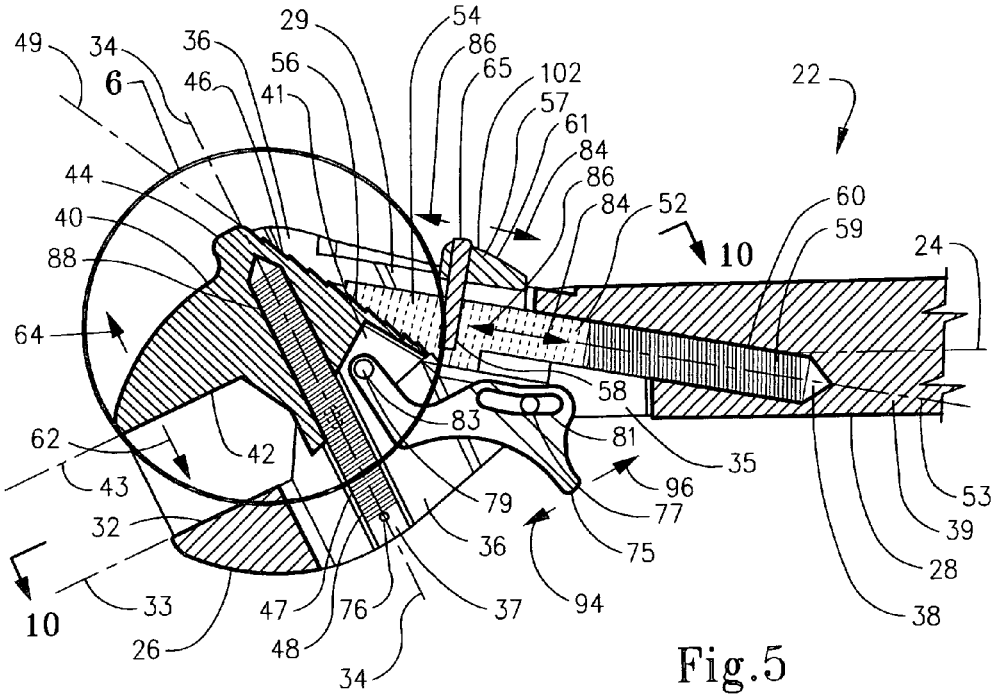
FIG. 5 shows an expanded view of the broad general interface between the movable jaw member, the beam, the trigger, and the handle member along with the means for urging the beam and the means for urging the movable jaw member.
Figure 6:
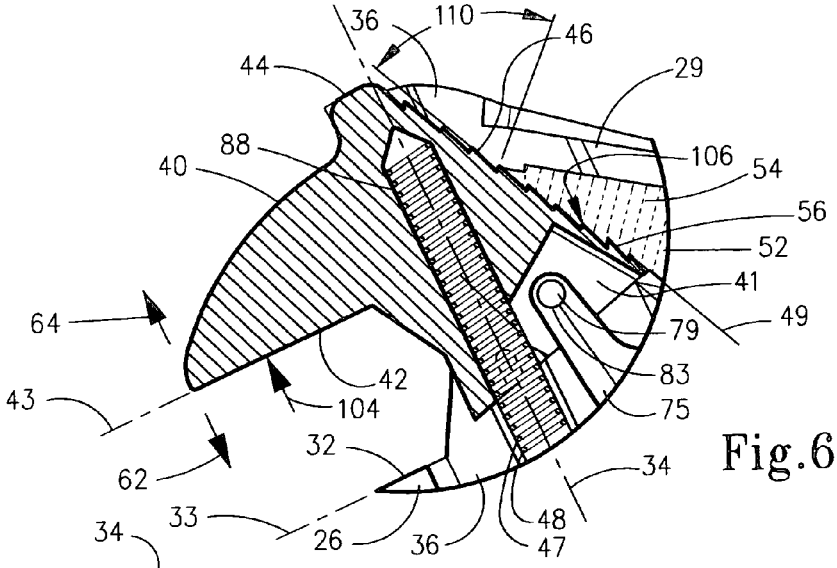
FIG. 6 shows an expanded view 6 from FIG. 5, showing the movable jaw member, beam, and trigger interface.
Figure 7:
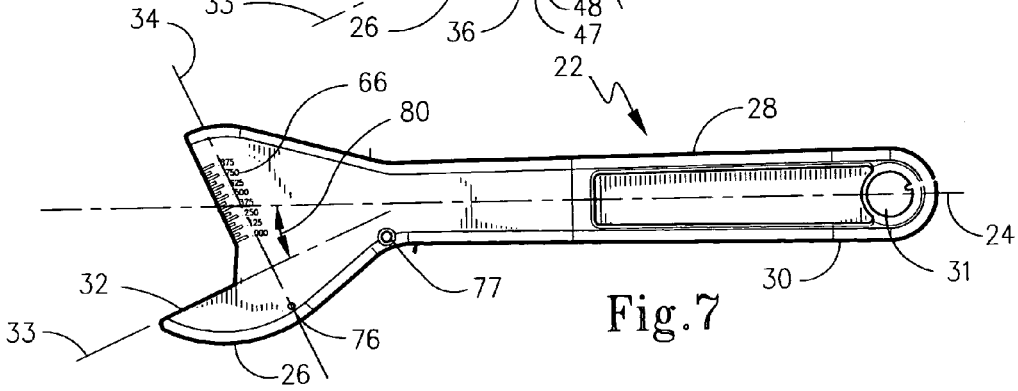
FIG. 7 shows a side view of the handle member.
Figure 8:
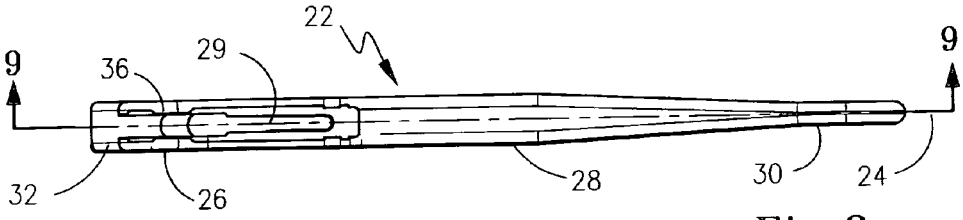
FIG. 8 shows a view of the handle member from the side opposite of the fixed jaw segment.
Figure 9:
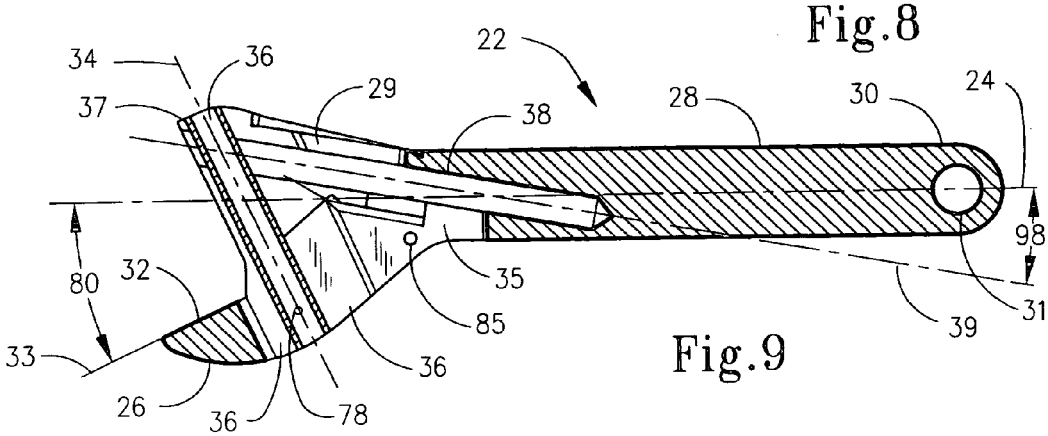
FIG. 9 shows crossectional cut 9—9 from FIG. 8, showing the handle member depicting the void, the fixed jaw segment, and the channel therethrough.
Figure 10:
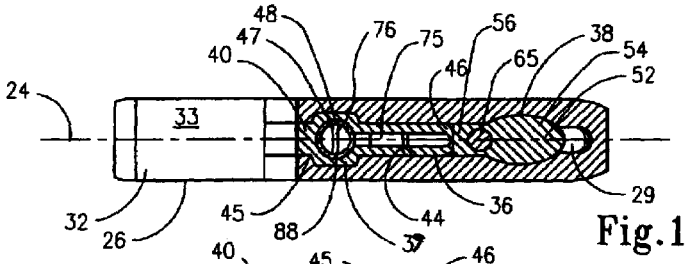
FIG. 10 shows crossectional cut 10—10 from FIG. 5, depicting the channel therethrough of the handle member with the slidable engagement of the movable jaw member and the beam.
Figure 11:
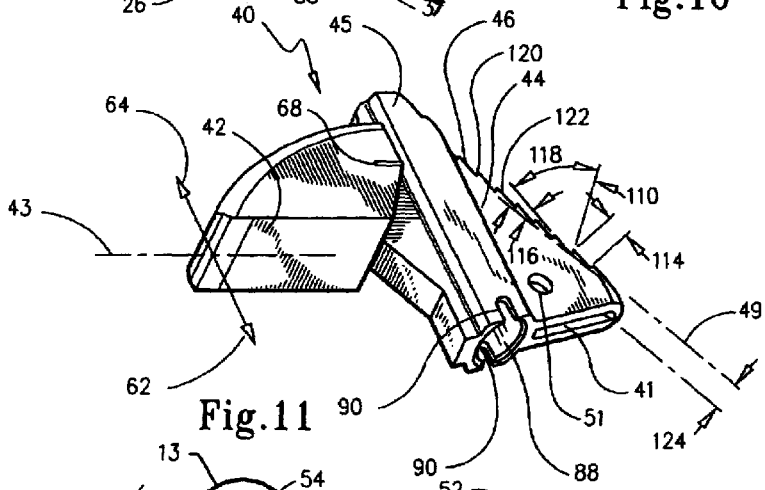
FIG. 11 shows a perspective view of the movable jaw member.
Figure 12:
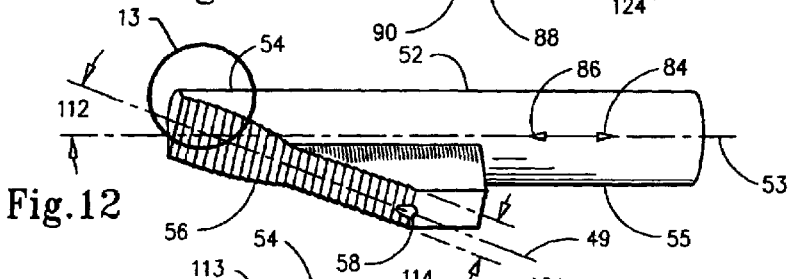
FIG. 12 shows a perspective view of the beam.
Figure 13:
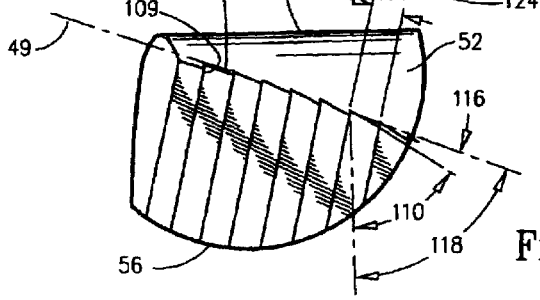
FIG. 13 shows expanded view 13 from FIG. 12 with a view of the serrated tooth section of the beam.
Figure 14:
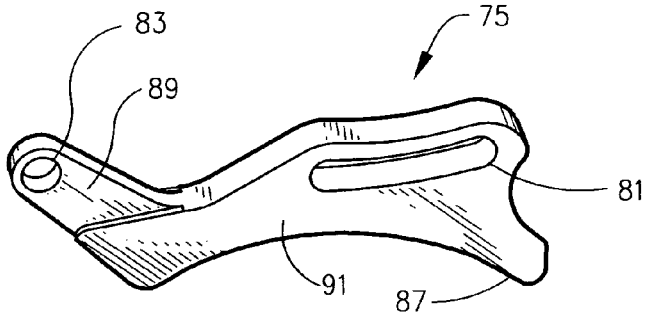
FIG. 14 shows a perspective view of the trigger.
Figure 15:
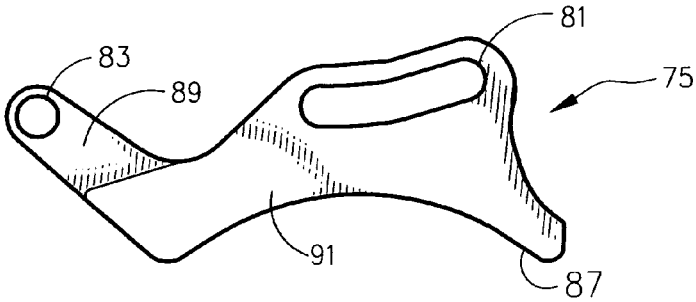
FIG. 15 shows a side view of the trigger.
Figure 16:
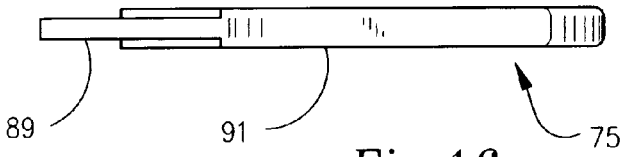
FIG. 16 shows a top view of the trigger.
Figure 17:
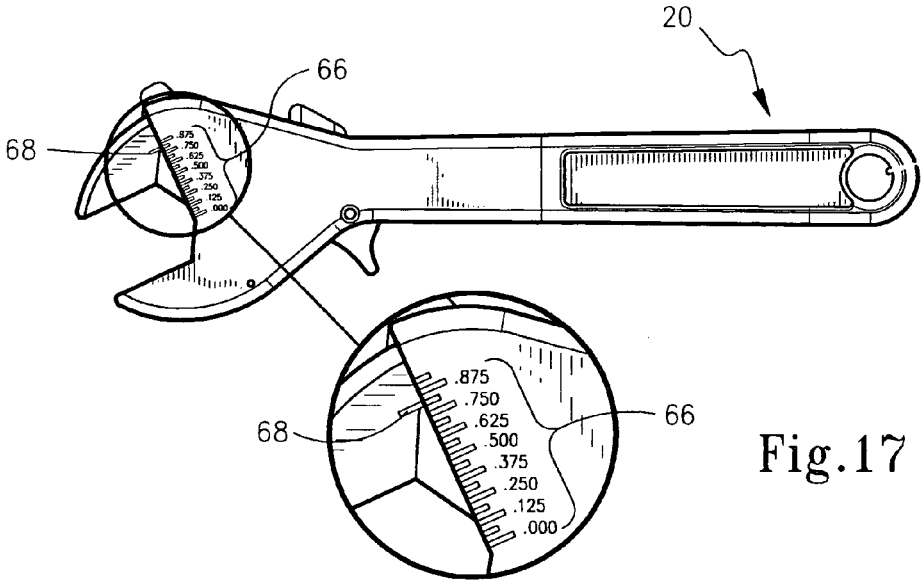
FIG. 17 shows an expanded view of the indicia between the movable jaw member and the handle member.

With initial reference to FIG. 1 shown is a perspective view of the adjustable wrench assembly 20 with the movable jaw member 40 moved toward the open state, FIG. 2 shows a side view of the adjustable wrench assembly 20 with the movable jaw member 40 moved toward the open state, with the wrench 20 suspended from the support member 70 through use of the suspension element 71, and FIG. 3 shows a view of the adjustable wrench assembly 20 from the movable jaw member 40 end. Further, FIG. 4 shows crossectional cut 4—4 from FIG. 3, depicting the broad general interface between the movable jaw member 40, the beam 52, the trigger 75, and the handle member 22 along with the means 59 for urging the beam 52 and the means 47 for urging the movable jaw member 40. Continuing, FIG. 5 shows an expanded view of the broad general interface between the movable jaw member 40, the beam 52, the trigger 75, and the handle member 22 along with the means 59 for urging the beam 52 and the means 47 for urging the movable jaw member 40, FIG. 6 shows an expanded view 6 from FIG. 5, showing the movable jaw member 40, beam 52, and trigger 75 interface, and FIG. 7 shows a side view of the handle member 22. Next, FIG. 8 shows a view of the handle member 22 from the side opposite of the fixed jaw segment 32 and FIG. 9 shows crossectional cut 9—9 from FIG. 8, showing the handle member 22 depicting the void 38, the fixed jaw segment 32, and the channel therethrough 36. Further continuing, FIG. 10 shows crossectional cut 10—10 from FIG. 5, depicting the channel therethrough 36 of the handle member 22 with the slidable engagement of the movable jaw member 40 and the beam 52, FIG. 11 shows a perspective view of the movable jaw member 40, and FIG. 12 shows a perspective view of the beam 52. Yet further, FIG. 13 shows view 13 from FIG. 12, showing an expanded view of the serrated tooth section rack 56 of the beam 52, FIG. 14 shows a perspective view of the trigger 75, and FIG. 15 shows a side view of the trigger 75. Finally, FIG. 16 shows a top view of the trigger 75 and FIG. 17 shows an expanded view of the handle member 22 indicia 66 and movable jaw member 40 indicia 68 between the movable jaw member 40 and the handle member 22.

Broadly the present invention of an adjustable wrench assembly 20 for loosening or tightening a fastener, includes a handle member 22 having a longitudinal axis 24 between a handle first end portion 26, a handle central portion 28, and a handle second end portion 30. The first end portion 26 includes a fixed jaw segment 32, a fixed jaw surface plane 33, and a transverse axis 34 to the fixed jaw surface plane 33. The first end portion 26 also includes a channel 36 therethrough positioned substantially parallel to the transverse axis 34, the central portion also includes a void 38 in communication with the channel 36, with the void 38 having a longitudinal axis 39. More particularly, on the channel 36 and in referring specifically to FIGS. 9 and 10, the channel 36 includes a recess 37 therethrough that is positioned substantially parallel to the channel 36. The basic handle member 22 is best shown in FIGS. 7, 8, and 9 as a single piece. The fixed jaw surface plane 33 forms angle 80 with the longitudinal axis 24, with an angle 80 of preferably about twenty five (25) degrees, however, other angles would be acceptable depending upon the requirements of the adjustable wrench 20 application. More particularly, on the void 38 as best shown in FIGS. 4 and 9, the void 38 longitudinal axis 39 forms an angle 98 to the handle member longitudinal axis 24 that is preferably about ten (10) degrees, however, angle 98 could be more or less depending upon handle member 22 size, material, beam 52 specifics, and moveable jaw member 40 function, and the like. The preferred materials of construction for the handle member 22 is 416 stainless steel, other materials would be acceptable that meet the functional requirements of wrench loading and/or manufacturing/cost considerations.

Also included in the adjustable wrench assembly 20 is a movable jaw member 40 including a movable jaw segment 42, a movable jaw surface plane 43, and an engagement portion 44, with the engagement portion 44 being slidably engaged within the channel 36 functioning operationally to move the movable jaw member 40 from an open state to a closed state and from the closed state to the open state. The movable jaw member 40 movement is shown as a direction of the movable jaw member 40 toward the closed state 62 and as a direction of the moveable jaw member 40 toward the open state 64. Wherein the closed state is where the movable jaw member 40 surface plane 43 and the fixed jaw segment surface plane 33 come into contact and the open state is when the movable jaw member 40 surface plane 43 and the fixed jaw segment 32 surface plane 33 are at their furthest separation as best shown in FIG. 4. The movable jaw member 40 also includes a serrated toothed rack 46 whose pitch line 49 forms an acute angle 50 in relation to the movable jaw surface plane 43. The movable jaw member 40 is best shown as a single piece in FIG. 11. The movable jaw member 40 surface plane 43 forms angle 82 with the longitudinal axis 24, with angle 82 being about twenty five (25) degrees, however, other angles would be acceptable depending upon the requirements of the adjustable wrench 20 application, wherein typically the fixed jaw 32 surface plane 33 and the moveable jaw member 40 surface plane 43 are typically substantially parallel throughout movement between the closed state and the open state and vice versa. More particularly, on the engagement portion 44 and in referring specifically to FIGS. 10 and 11, the engagement portion 44 includes a rib portion 45 that slidably engages within the channel recess 37. Wherein the purpose of the slidable engagement between the rib portion 45 and the channel recess 37 is to help movement being denoted as movement 62 toward the closed state and movement 64 toward the open state, of the movable jaw member 40 in the channel 36 to remain substantially along the transverse axis 34 during the application of loading from the fastener as shown by force 104 in FIG. 6, or in other words for the fixed jaw 32 surface plane 33 and the moveable jaw member 40 surface plane 43 to remain substantially parallel throughout movement between the closed state and the open state and vice versa. The preferred materials of construction for the moveable jaw member 40 is 416 stainless steel, other materials would be acceptable that meet the functional requirements of wrench loading and/or manufacturing/cost considerations.

Further included in the adjustable wrench assembly 20 is a beam 52 having a longitudinal axis 53, with the beam 52 being slidably engaged for reciprocative movement within the void 38. The beam 52 includes an end portion 54 capable of projecting into the channel 36, with the beam 52 end portion 54 having a serrated toothed rack 56 that selectively matably engages with the movable jaw member 40 serrated toothed rack 46. Also, the beam 52 includes a non toothed end portion 55 as best shown in FIG. 12 that is slidably engaged within the void 38. The serrated toothed rack 56 has a pitch line 49 that forms angle 112 with the beam 52 longitudinal axis 53, wherein the angle 112 is preferably about twenty five (25) degrees, however, angle 112 could be more or less depending upon the amount of force 104, materials used, costs, manufacturing needs, and/or the like dictate in the design. Wherein the beam 52 is operational to help secure the movable jaw member 40 at a selected position between the closed state and the open state when the beam 52 serrated toothed rack 56 matably engages with the movable jaw member 40 serrated toothed rack 46. The preferred materials of construction for the beam 52 is 416 stainless steel, other materials would be acceptable that meet the functional requirements of wrench loading and/or manufacturing/cost considerations.

Also included in the adjustable wrench assembly 20 is a trigger member 75 that is pivotally attached to the movable jaw member 40 and slidably engaged to the handle member 22. Wherein the trigger 75 is operational to facilitate manual movement of the movable jaw member 40 from the closed state to the open state and from the open state to the closed state. Further, on the trigger 75 and focusing particularly on FIGS. 14, 15, and 16, included in the trigger 75 is an extension 89 having an aperture 83, a body 91 with a slot 81, and a finger grip 87. The extension 89 is pivotally attached at the aperture 83 to the movable jaw member 40 and in particular within the movable jaw member 40 slot void 41 at aperture 51 (as best shown in FIG. 11 for the movable jaw member 40) utilizing a conventional pin 79 that can be a press fit pin, roll pin, and the like. Continuing on the trigger 75, the slot 81 is slidably engaged to the handle member 22, being disposed within the handle central portion 28 second aperture 35, specifically with the slot 81 retained by a conventional pin 77 that can also be a press fit pin, roll pin, and the like. Wherein the finger grip 87 is operational to facilitate manual movement of the movable jaw member 40 from the closed state to the open state and from the open state to the closed state, in referring to FIG. 5 in particular the movement of the trigger 75 and specifically the finger grip 87, movement 94 acts to move the moveable jaw member 40 to the open state and movement 96 acts to move the moveable jaw member 40 to the closed state when the beam 52 serrated toothed rack 56 is selectively disengaged from the movable jaw member 40 serrated toothed rack 46. The preferred materials of construction for the trigger member 75 is a plastic such as DELRIN, other materials would be acceptable that meet the functional requirements of wrench loading and/or manufacturing/cost considerations.

Optionally, the adjustable wrench assembly 20 can further comprise a means 59 for urging the beam 52 serrated toothed rack 56 to matably engage with the movable jaw member 40 serrated toothed rack 46. Wherein the means 59 also assists in urging the movable jaw member 40 to a selected position moving from the open state to the closed reference movement direction 62, resulting in the movable jaw member 40 in a secured position state upon the fastener as against moving the moveable jaw member 40 toward the open state reference movement direction 64, being operational to allow the adjustable wrench assembly 20 to loosen or tighten the fastener. The means 59 is preferably a beam spring element 60, however, alternatives would be acceptable such as Bellville or wavy springs, resilient elements, and the like.

In addition, another option for the adjustable wrench assembly 20 is to further comprise a means 47 for urging the movable jaw member 40 toward the open state, being operational to allow the movable jaw member 40 to move to the open state, reference movement direction 64, being accomplished by disengaging the beam 52 serrated toothed rack 56 from the movable jaw member 40 serrated toothed rack 46. The means 47 is preferably a movable jaw member 40 spring element 48, however, also alternatives would be acceptable such as Bellville or wavy springs, resilient elements, and the like. As best shown in FIGS. 4, 5, 6, 10, and 11 the spring element 48 is disposed within moveable jaw member 40 void 88 and retained by pin 76 in the handle member 22 first end portion 26 adjacent to the channel 36. Note that there is also a pin 76 clearance 90 as best shown in FIG. 11 in the moveable jaw member 40. The pin 76 can be a press fit pin, roll pin, and the like. Continuing on the adjustable wrench assembly 20 there is an option for a means 61 for manually disengaging the beam 52 serrated toothed rack 56 from the movable jaw member 40 serrated toothed rack 46, being operational to facilitate free slidable engagement of the movable jaw member 40 within the channel 36 between the open state and the closed state and vice versa as previously described. More particularly, on the means 61 for manually disengaging the beam 52 serrated toothed rack 56 from the movable jaw member 40 serrated toothed rack 46, included is a first aperture 29 in the handle 22 central portion 28 that is in communication with the void 38, wherein the first aperture 29 is positioned substantially parallel lengthwise to the void 38 longitudinal axis 39. Further, on the means 61, the beam 52 includes an extension 57 positioned substantially transverse to the beam 52 longitudinal axis 53, the beam 52 extension 57 is sized and configured to slidably project therethrough the handle 22 central portion 28 first aperture 29 (as best shown in FIGS. 1, 2, 4, and 5). The extension 57 includes a pin 65 that is received in a beam 52 aperture 58 with a thumb grip 102. Pin 65 can be a press fit pin, roll pin, and the like. Wherein the beam 52 extension 57 is operational to allow manual reciprocative movement of the beam 52 within the void 38, further allowing the beam 52 serrated toothed rack 56 to selectably matably engage with the movable jaw member 40 serrated toothed rack 46 and to selectably disengage the beam 52 serrated toothed rack 56 and the movable jaw member 40 serrated toothed rack 46 from one another. The manual reciprocative movement of the beam 52 within the void 38 utilizing the extension 57 is shown by movement 84 that manually disengages the beam 52 serrated toothed rack 56 and the movable jaw member 40 serrated toothed rack 46 and movement 86 that manually matably engages the beam 52 serrated toothed rack 56 with the movable jaw member 40 serrated toothed rack 46, functioning to help secure the moveable jaw member 40 at a selected position against opening movement 64 to tighten or loosen a fastener. More particularly, on the movable jaw member 40 serrated toothed rack 46 and the beam 52 serrated toothed rack 56 that are matingly engagable and share the same pitch line 49 wherein the pitch line 49 angle 50 is an acute angle to the movable jaw member 40 surface plane 43, with the preferred angle 50 being about sixty (60) degrees which acts to assist in closing the movable jaw member 40 toward the closed state, reference movement 62 when the beam 52 moves in the reference direction 86, thus assisting in a "cinching" of the moveable jaw member 40 onto the fastener and with the beam 52 serrated tooth rack 56 matingly engaging the moveable jaw member 40 serrated tooth rack 46 being operational to help secure the moveable jaw member 40 against opening force 104 by reactionary force 106 as shown in FIG. 6. Further, to help the mating engagement of the beam 52 serrated tooth rack 56 to the moveable jaw member 40 serrated tooth rack 46, the beam 52 serrated tooth rack 56 face 113 and step 109 have an acute angle 110 relationship as does the moveable jaw member 40 serrated tooth rack 46 face 122 and step 120. The acute angle 110 is preferably about seventy (70) degrees for both the beam 52 serrated tooth rack 56 and the moveable jaw member 40 serrated tooth rack 46 as they are matingly engagable, thus having steps 109, 120, faces 113, 122, and angular 110 relations between the steps 109, 120 and faces 113, 122 matched respectively. This acute angle 110 helps facilitate the steps 109, 120 to interlock when the beam 52 serrated tooth rack 56 and the moveable jaw member 40 serrated tooth rack 46 are matingly engaged and force 104 is applied when a fastener is tightened or loosened.

Thus there is not the traditional or conventional separating force associated with conventional meshing gears that are loaded with torque resulting in a tangential gear tooth force that tends to drive the gears apart. The result of the acute angle 110 is to help pull the beam 52 serrated tooth rack 56 and the moveable jaw member 40 serrated tooth rack 46 together with the application of force 104 in conjunction with reaction force 106. Further, the beam 52 serrated tooth rack 56 and the moveable jaw member 40 serrated tooth rack 46 have angle 118 that is between the steps 109, 120 and the pitch line 49 that is preferably about eighty (80) degrees, resulting in angle 116 preferably being about ten (10) degrees. Also, the face height 114 for both beam 52 serrated tooth rack 56 and the moveable jaw member 40 serrated tooth rack 46 is preferably about thirty thousandths (0.030) of an inch, however, the aforementioned angles and dimensions could be changed as conventional serrated toothed rack design requires based upon the amount of force 104, materials used, costs, manufacturing needs, and/or the like dictate in the design. In addition, the width 124 of both beam 52 serrated tooth rack 56 and the moveable jaw member 40 serrated tooth rack 46, with the width being defined as transverse to the face height 114 or the pitch line 49 is about one hundred and eighty eight thousandths (0.188) of an inch, however, other sizes would also be allowable being dictated by conventional serrated toothed rack design requirements based upon the amount of force 104, material used, costs, manufacturing needs, and/or the like dictate in the design.

Continuing further on the wrench assembly 20 an optional aperture 31 can be included that is operational to suspend the handle member from a support member 70, through the use of a suspension element 71, this is allow the wrench assembly 20 to hang from a wall and the like. Additionally, as a convenience to the user the wrench assembly 20 can include on the handle 22 first end portion 26 fixed jaw segment 32 and on the movable jaw member 40, to each have a fastener size indicia visibly disposed on each of the fixed jaw segment indicia 66 and on the movable jaw member 40 indicia 68 to identify the relative fixed jaw segment 32 position to the moveable jaw member 40 position corresponding to a fastener size being preferably english and/or metric units of measure.

When both the beam 52 spring element 60 and the moveable jaw member 40 spring element 48 are utilized in the adjustable wrench assembly 20, a spring rate relation is desired in that spring element 60 has a higher strength in pounds per inch than the spring element 48 in pounds per inch. The functional purpose is in only having spring element 48 have enough strength in pounds per inch to overcome the weight of the moveable jaw member 40 and the friction of the slidable engagement of the moveable jaw member 40 engagement portion 44 in the handle member 22 channel 36 to facilitate the spring element 48 creating movement 64 of the moveable jaw member 40 to the open state (as previously described) when the beam 52 serrated toothed rack 56 is selectively disengaged from the movable jaw member 40 serrated toothed rack 46. Further, the spring element 60 preferably having a higher pounds per inch rating than the spring element 48 helps to facilitate spring element 60 assisting in urging the movable jaw member 40 in directional movement 62 to a selected position moving from the open state to the closed state resulting in the movable jaw member 40 in a secured position state upon the fastener against moving toward the open state in direction 64, being operational to allow the adjustable wrench assembly 20 to loosen or tighten the fastener. Preferably spring element 60 is constructed of stainless steel wire at a rate of about two and one half (2.5) pounds per inch and spring element 48 is constructed of stainless steel wire at a rate of about one half (0.5) pounds per inch, however, alternate spring types and rates in pounds per inch could be used as design needs dictate.

As an alternative embodiment of the adjustable wrench assembly 20 for loosening or tightening a fastener, broadly included is a handle member 22 having a longitudinal axis 24 between a handle first end portion 26, a handle central portion 28, and a handle second end portion 30. The first end portion 26 includes a fixed jaw segment 32, a fixed jaw surface plane 33, and a transverse axis 34 to the fixed jaw surface plane 33. The first end portion 26 also includes a channel 36 therethrough positioned substantially parallel to the transverse axis 34, the central portion also includes a void 38 in communication with the channel 36, with the void 38 having a longitudinal axis 39. More particularly, on the channel 36 and in referring specifically to FIGS. 9 and 10, the channel 36 includes a recess 37 therethrough that is positioned substantially parallel to the channel 36. The basic handle member 22 is best shown in FIGS. 7, 8, and 9 as a single piece. The fixed jaw surface plane 33 forms angle 80 with the longitudinal axis 24, with angle 80 being preferably about twenty five (25) degrees, however, other angles would be acceptable depending upon the requirements of the adjustable wrench 20 application. More particularly, on the void 38 as best shown in FIGS. 4 and 9, the void 38 longitudinal axis 39 forms an angle 98 to the handle member longitudinal axis 24, with angle 98 being preferably about ten (10) degrees, however, angle 98 could be more or less depending upon handle member 22 size, material, beam 52 specifics, and moveable jaw member 40 function, and the like. The preferred materials of construction for the handle member 22 is 416 stainless steel, other materials would be acceptable that meet the functional requirements of wrench loading and/or manufacturing/cost considerations.

Also included in the alternative embodiment of the adjustable wrench assembly 20, is a movable jaw member 40 including a movable jaw segment 42, a movable jaw surface plane 43, and an engagement portion 44, with the engagement portion 44 being slidably engaged within the channel 36 functioning operationally to move the movable jaw member 40 from an open state to a closed state and from the closed state to the open state. The movable jaw member 40 movement is shown as a direction of the movable jaw member 40 toward the closed state 62 and as a direction of the moveable jaw member 40 toward the open state 64. Wherein the closed state is where the movable jaw member 40 surface plane 43 and the fixed jaw segment surface plane 33 come into contact and the open state is when the movable jaw member 40 surface plane 43 and the fixed jaw segment 32 surface plane 33 are at their furthest separation as best shown in FIG. 4. The movable jaw member 40 also includes a serrated toothed rack 46 whose pitch line 49 forms an acute angle 50 in relation to the movable jaw surface plane 43. The movable jaw member 40 is best shown as a single piece in FIG. 11. The movable jaw member 40 surface plane 43 forms angle 82 with the longitudinal axis 24, with angle 82 being preferably about twenty five (25) degrees, however, other angles would be acceptable depending upon the requirements of the adjustable wrench 20 application, wherein typically the fixed jaw 32 surface plane 33 and the moveable jaw member 40 surface plane 43 are typically substantially parallel throughout reference movement 64 to the open state and movement 62 to the closed state.

More particularly, on the engagement portion 44 and in referring specifically to FIGS. 10 and 11, the engagement portion 44 includes a rib portion 45 that slidably engages within the channel recess 37. Wherein the purpose of the slidable engagement between the rib portion 45 and the channel recess 37 is to help movement being denoted as movement 62 toward the closed state and movement 64 toward the open state, of the movable jaw member 40 in the channel 36 remain substantially along the transverse axis 34 during the application of loading from the fastener as shown by force 104 in FIG. 6, or in other words for the fixed jaw 32 surface plane 33 and the moveable jaw member 40 surface plane 43 to remain substantially parallel throughout movement between the closed state and the open state and vice versa. The preferred materials of construction for the moveable jaw member 40 is 416 stainless steel, other materials would be acceptable that meet the functional requirements of wrench loading and/or manufacturing/cost considerations.

Further included in the alternative embodiment of the adjustable wrench assembly 20 is a beam 52 having a longitudinal axis 53, with the beam 52 being slidably engaged for reciprocative movement within the void 38. The beam 52 includes an end portion 54 capable of projecting into the channel 36, with the beam 52 end portion 54 having a serrated toothed rack 56 that selectively matably engages with the movable jaw member 40 serrated toothed rack 46. Also, the beam 52 includes a non toothed end portion 55 as best shown in FIG. 12 that is slidably engaged within the void 38. The serrated toothed rack 56 has a pitch line 49 that forms angle 112 with the beam 52 longitudinal axis 53, wherein the angle 112 is preferably twenty five (25) degrees, however, angle 112 could be more or less depending upon the amount of force 104, materials used, costs, manufacturing needs, and/or the like dictate in the design. Wherein the beam 52 is operational to help secure the movable jaw member 40 at a selected position between the closed state and the open state when the beam 52 serrated toothed rack 56 matably engages with the movable jaw member 40 serrated toothed rack 46. The preferred materials of construction for the beam 52 is 416 stainless steel, other materials would be acceptable that meet the functional requirements of wrench loading and/or manufacturing/cost considerations.

Continuing, the alternative embodiment of the adjustable wrench assembly 20 further comprises a means 59 for urging the beam 52 serrated toothed rack 56 to matably engage with the movable jaw member 40 serrated toothed rack 46. Wherein the means 59 assists in urging the movable jaw member 40 to a selected position moving from the open state to the closed state, reference movement 62, resulting in the movable jaw member 40 in a secured position state upon the fastener against moving toward the open state, reference movement 64, being operational to allow the adjustable wrench 20 to loosen or tighten the fastener. The means 59 is preferably a beam spring element 60, however, alternatives would be acceptable such as Bellville or wavy springs, resilient elements, and the like.

Further, on the alternative embodiment of the adjustable wrench assembly 20 there is a means 61 for manually disengaging the beam 52 serrated toothed rack 56 from the movable jaw member 40 serrated toothed rack 46, being operational to facilitate free slidable engagement of the movable jaw member 40 within the channel 36 between the open state and the closed state and vice versa as previously described. More particularly, on the means 61 for manually disengaging the beam 52 serrated toothed rack 56 from the movable jaw member 40 serrated toothed rack 46, includes a first aperture 29 in the handle 22 central portion 28 that is in communication with the void 38, wherein the first aperture 29 is positioned substantially parallel lengthwise to the void 38 longitudinal axis 39. Further, on the means 61 the beam 52 includes an extension 57 positioned substantially transverse to the beam 52 longitudinal axis 53, the beam 52 extension 57 is sized and configured to slidably project therethrough the handle 22 central portion 28 first aperture 29 (as best shown in FIGS. 1, 2, 4, and 5). The extension 57 includes a pin 65 that is received in a beam 52 aperture 58 with a thumb grip 102. Pin 65 can be a press fit pin, roll pin, and the like. Wherein the beam 52 extension 57 is operational to allow manual reciprocative movement of the beam 52 within the void 38 further allowing the beam 52 serrated toothed rack 56 to selectably matably engage with the movable jaw member 40 serrated toothed rack 46 and to selectably disengage the beam 52 serrated toothed rack 56 and the movable jaw member 40 serrated toothed rack 46 from one another. The manual reciprocative movement of the beam 52 within the void 38 utilizing the extension 57 is shown by movement 84 that manually disengages the beam 52 serrated toothed rack 56 and the movable jaw member 40 serrated toothed rack 46 and movement 86 that manually matably engages the beam 52 serrated toothed rack 56 with the movable jaw member 40 serrated toothed rack 46, functioning to help secure the moveable jaw member 40 at a selected position against opening movement 64 to tighten or loosen a fastener.

Optionally, for the alternative embodiment for the adjustable wrench assembly 20 is a trigger member 75 that is pivotally attached to the movable jaw member 40 and slidably engaged to the handle member 22. Wherein the trigger 75 is operational to facilitate manual movement of the movable jaw member 40 from the closed state to the open state and from the open state to the closed state as previously described. Further, on the trigger 75 and focusing particularly on FIGS. 14, 15, and 16 included in the trigger 75 is an extension 89 having an aperture 83, a body 91 with a slot 81, and a finger grip 87. The extension 89 is pivotally attached at the aperture 83 to the movable jaw member 40 and in particular the movable jaw member 40 slot void 41 at aperture 51 (as best shown in FIG. 11 for the movable jaw member 40) utilizing a conventional pin 79 that can be a press fit pin, roll pin, and the like. Continuing on the trigger 75, the slot 81 is slidably engaged to the handle member 22, being disposed within the handle central portion 28 second aperture 35, with the slot 81 retained by a conventional pin 77 that can be a press fit pin, roll pin, and the like. Wherein the finger grip 87 is operational to facilitate manual movement of the movable jaw member 40 from the closed state to the open state and from the open state to the closed state, in referring to FIG. 5 in particular the movement of the trigger 75 and specifically the finger grip 87, movement 94 acts to move the moveable jaw member 40 to the open state, reference movement 64, and movement 96 acts to move the moveable jaw member 40 to the closed state, reference movement 62 when the beam 52 serrated toothed rack 56 is selectively disengaged from the movable jaw member 40 serrated toothed rack 46. The preferred materials of construction for the trigger member 75 is a plastic such as DELRIN, other materials would be acceptable that meet the functional requirements of wrench loading and/or manufacturing/cost considerations.

In addition, an option for the alternative embodiment of the adjustable wrench assembly 20 is to further comprise a means 47 for urging the movable jaw member 40 toward the open state, reference movement 64, being operational to allow the movable jaw member 40 to move to the open state by disengaging the beam 52 serrated toothed rack 56 from the movable jaw member 40 serrated toothed rack 46. The means 47 is preferably a movable jaw member 40 spring element 48, however, alternatives would be acceptable such as Bellville or wavy springs, resilient elements, and the like. As best shown in FIGS. 4, 5, 6, 10, and 11 the spring element 48 is disposed within moveable jaw member 40 void 88 and retained by pin 76 in the handle member 22 first end portion 26 adjacent to the channel 36. Note that there is also a pin 76 clearance 90 as best shown in FIG. 11 in the moveable jaw member 40. The pin 76 can be a press fit pin, roll pin, and the like.

Continuing further on the alternative embodiment of the adjustable wrench assembly 20 an optional aperture 31 can be included that is operational to suspend the handle member from a support member 70, through the use of a suspension element 71, this is allow the wrench assembly 20 to hang from a wall and the like. Additionally, as a convenience to the user, the wrench assembly 20 can include on the handle 22 first end portion 26 fixed jaw segment 32 and on the movable jaw member 40, can each have a fastener size indicia visibly disposed on each of the fixed jaw segment indicia 66 and on the movable jaw member 40 indicia 68 to identify the relative fixed jaw segment 32 position to the moveable jaw member 40 position corresponding to a fastener size being preferably english or metric units of measure.

Continuing on the alternative embodiment of the adjustable wrench assembly 20 and more particularly on the movable jaw member 40 serrated toothed rack 46 and the beam 52 serrated toothed rack 56 that are matingly engagable and share the same pitch line 49 wherein the pitch line 49 angle 50 is an acute angle to the movable jaw member 40 surface plane 43, with the preferred angle 50 being about sixty (60) degrees which acts to assist in closing the movable jaw member 40 toward the closed state, reference movement 62 when the beam 52 moves in the reference direction 86, thus assisting in a "cinching" of the moveable jaw member 40 onto the fastener and with the beam 52 serrated tooth rack 56 matingly engaging the moveable jaw member 40 serrated tooth rack 46 is operational to help secure the moveable jaw member 40 against opening force 104, reference movement 64, by reactionary force 106 as shown in FIG. 6. Further to help the mating engagement of the beam 52 serrated tooth rack 56 to the moveable jaw member 40 serrated tooth rack 46, the beam 52 serrated tooth rack 56 face 113 and step 109 have an acute angle 110 relationship as does the moveable jaw member 40 serrated tooth rack 46 face 122 and step 120. The acute angle 110 is preferably about seventy (70) degrees for both the beam 52 serrated tooth rack 56 and the moveable jaw member 40 serrated tooth rack 46 as they are matingly engagable, thus having steps 109, 120, faces 113, 122, and angular 110 relations between the steps 109, 120 and faces 113, 122 matched respectively. This acute angle 110 helps facilitate the steps 109, 120 to interlock when the beam 52 serrated tooth rack 56 and the moveable jaw member 40 serrated tooth rack 46 are matingly engaged and force 104 is applied when a fastener is tightened or loosened.

Thus there is not the traditional or conventional separating force associated with conventional meshing gears that are loaded with torque resulting in a tangential gear tooth force that tends to drive the gears apart. The result of the acute angle 110 is to help pull the beam 52 serrated tooth rack 56 and the moveable jaw member 40 serrated tooth rack 46 together with the application of force 104. Further, the beam 52 serrated tooth rack 56 and the moveable jaw member 40 serrated tooth rack 46 have angle 118 that is between the steps 109, 120 and the pitch line 49 that is preferably about eighty (80) degrees, resulting in angle 116 preferably being about ten (10) degrees. Also, the face height 114 for both beam 52 serrated tooth rack 56 and the moveable jaw member 40 serrated tooth rack 46 is preferably about thirty thousandths (0.030) of an inch, however, the aforementioned angles and dimensions could be changed as conventional serrated toothed rack design requires based upon the amount of force 104, materials used, costs, manufacturing needs, and/or the like dictate in the design. In addition, the width 124 of both beam 52 serrated tooth rack 56 and the moveable jaw member 40 serrated tooth rack 46, with the width being defined as transverse to the face height 114 or the pitch line 49 is about one hundred and eighty eight thousandths (0.188) of an inch, however, other sizes would also be allowable being dictated by conventional serrated toothed rack design requirements based upon the amount of force 104, material used, costs, manufacturing needs, and/or the like dictate in the design.

When both the beam 52 spring element 60 and the moveable jaw member 40 spring element 48 are utilized in the alternative embodiment of the adjustable wrench assembly 20, a spring rate relation is desired in that spring element 60 has a higher strength in pounds per inch than the spring element 48 rate in pounds per inch. The functional purpose is in only having spring element 48 have enough strength in pounds per inch to overcome the weight of the moveable jaw member 40 and the friction of the slidable engagement of the moveable jaw member 40 engagement portion 44 in the handle member 22 channel 36 to facilitate the spring element 48 creating movement 64 of the moveable jaw member 40 to the open state (as previously described) when the beam 52 serrated toothed rack 56 is selectively disengaged from the movable jaw member 40 serrated toothed rack 46. Further, the spring element 60 preferably having a higher pounds per inch rating than the spring element 48 helps to facilitate spring element 60 assisting in urging the movable jaw member 40 in directional movement 62 to a selected position moving from the open state to the closed state resulting in the movable jaw member 40 in a secured position state upon the fastener against moving toward the open state in direction 64, being operational to allow the adjustable wrench assembly 20 to loosen or tighten the fastener. Preferably spring element 60 is constructed of stainless steel wire at a rate of about two and one half (2.5) pounds per inch and spring element 48 is constructed of stainless steel wire at a rate of about one half (0.5) pounds per inch, however, alternate spring types and rates in pounds per inch could be used as design needs dictate.

Method of Use

Referring to FIGS. 1, 2, 3, 4, 5, and 17 a method of using the adjustable wrench assembly 20 for loosening or tightening a fastener, comprises the steps of, first providing an adjustable wrench assembly 20. The adjustable wrench assembly 20 includes a handle member 22 with a fixed jaw segment 32, a movable jaw member 40 with a serrated toothed rack 46, a beam 52 with a serrated toothed rack 56, a means 59 for urging the beam 52 serrated toothed rack 56 to matably engage with the movable jaw member 40 serrated toothed rack 46. Wherein the movable jaw member 40 is assisted in urging toward a closed state and secured position state upon the fastener against moving toward the open state by the means 59. Also included in the adjustable wrench assembly 20 is a means 61 for manually selectively disengaging the beam 52 serrated toothed rack 56 from the movable jaw member 40 serrated toothed rack 46, and a trigger member 75 pivotally attached to the movable jaw member 40 and slidably engaged to the handle member 22. The trigger member 75 facilitating manual movement of the movable jaw member 40 from the closed state to the open state and from the open state to the closed state when the beam 52 serrated toothed rack 56 is selectively disengaged from the movable jaw member 40 serrated toothed rack 46.

Further, a next step is in manually grasping the handle member 22 of the adjustable wrench assembly 20 and then a step of moving and holding the means 61 for manually selectively disengaging the beam 52 serrated toothed rack 56 from the movable jaw member 40 serrated toothed rack 46. Continuing, the next step is in moving the trigger member 75 as shown by trigger member 75 movement 94 to open 64 the movable jaw member 40 and by trigger member 75 movement 96 to close 62 the moveable jaw member 40 facilitating a selective positioning the movable jaw member 40 between the closed state and the open state, wherein the further step of positioning the fixed jaw segment 32 and the movable jaw member 40 on the fastener is completed.

Once the positioning the fixed jaw segment 32 and the movable jaw member 40 on the fastener is completed, a subsequent step is in releasing the means 61 for manually disengaging the beam 52 serrated toothed rack 56 from the movable jaw member 40 serrated toothed rack 46, thus allowing the means 59 for urging the beam 52 serrated toothed rack 56 to matably engage with the movable jaw member 40 serrated toothed rack 46, resulting in the movable jaw member 40 being in a substantially secured position state upon the fastener, with the moveable jaw member 40 resisting movement 64 toward the open state. Finally, a step of applying manual force to the handle member 22 that is operational to loosen or tighten the fastener as is well known in the art.

Optionally, an additional step of combining the following steps of; (c) moving and holding the means 61 for manually selectively disengaging the beam 52 serrated toothed rack 56 from the movable jaw member 40 serrated toothed rack 46. Continuing, the next step (d) is in moving the trigger member 75 as shown by trigger member 75 movement 94 to open 64 the movable jaw member 40 and by trigger member 75 movement 96 to close 62 the moveable jaw member 40 facilitating a selective positioning the movable jaw member 40 between the closed state and the open state, wherein the further step (e) of positioning the fixed jaw segment 32 and the movable jaw member 40 on the fastener is completed. Once the positioning the fixed jaw segment 32 and the movable jaw member 40 on the fastener is completed, a subsequent step (f) is in releasing the means 61 for manually disengaging the beam 52 serrated toothed rack 56 from the movable jaw member 40 serrated toothed rack 46, thus allowing the means 59 for urging the beam 52 serrated toothed rack 56 to matably engage with the movable jaw member 40 serrated toothed rack 46, resulting in the movable jaw member 40 being in a substantially secured position state upon the fastener, with the moveable jaw member 40 resisting movement 64 toward the open state. Finally, the step (g) of applying manual force to the handle member 22 that is operational to loosen or tighten the fastener as is well known in the art. With the aforementioned steps (c), (d), (e), (f), and (g) being sequentially repeated to provide for a ratcheting action of the adjustable wrench assembly 20 to loosen or tighten the fastener.

CONCLUSION

Accordingly, the present invention of an adjustable wrench assembly has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

What is claimed is:

1. An adjustable wrench for loosening or tightening a fastener, comprising:

(a) a handle member having a longitudinal axis between a handle first end portion, a handle central portion, and a handle second end portion, said first end portion including a fixed jaw segment, a fixed jaw surface plane, and a transverse axis to said fixed jaw surface plane, said first end portion also includes a channel therethrough positioned substantially parallel to said transverse axis, said central portion includes a void in communication with said channel, with said void having a longitudinal axis;

(b) a movable jaw member including a movable jaw segment, a movable jaw surface plane, and an engagement portion, said engagement portion is slidably engaged within said channel being operational to move said movable jaw member from an open state to a closed state and from the closed state to the open state, said movable jaw member also includes a serrated toothed rack whose pitch line forms an acute angle in relation to said movable jaw surface plane;

(c) a beam having a longitudinal axis, said beam is slidably engaged for reciprocative movement within said void, said beam including an end portion capable of projecting into said channel, said end portion having a serrated toothed rack that selectively matably engages with said movable jaw member serrated toothed rack, wherein said beam is operational to help secure said movable jaw member at a selected position between the closed state and the open state when said beam serrated toothed rack matably engages with said movable jaw member serrated toothed rack; and (d) a trigger member pivotally attached to said movable jaw member and slidably engaged to said handle member, wherein said trigger is operational to facilitate manual movement of said movable jaw member from the closed state to the open state and from the open state to the closed state when said beam serrated toothed rack is selectively disengaged from said movable jaw member serrated toothed rack.

2. An adjustable wrench according to claim 1 further comprising a means for urging said beam serrated toothed rack to matably engage with said movable jaw member serrated toothed rack, wherein said means assists in urging said movable jaw member to a selected position moving from the open state to the closed state resulting in said movable jaw member in a secured position state upon the fastener against moving toward the open state, being operational to allow said adjustable wrench to loosen or tighten the fastener.

3. An adjustable wrench according to claim 2 wherein said means for urging said beam serrated toothed rack to matably engage with said movable jaw member serrated toothed rack is accomplished by a beam spring element.

4. An adjustable wrench according to claim 1 further comprising a means for urging said movable jaw member toward the open state, being operational to allow said movable jaw member to move to the open state one by disengaging said beam serrated toothed rack from said movable jaw member serrated toothed rack.

5. An adjustable wrench according to claim 4 wherein said means for urging said movable jaw member into an open state is accomplished by a movable jaw member spring element.

6. An adjustable wrench according to claim 1 wherein said trigger includes an extension, a body with a slot, and a finger grip, said extension is pivotally attached to said movable jaw member and said slot is slidably engaged to said handle member, wherein said finger grip is operational to facilitate manual movement of said movable jaw member from the closed state to the open state and from the open state to the closed state.

7. An adjustable wrench according to claim 2 further comprising a means for manually disengaging said beam serrated toothed rack from said movable jaw member serrated toothed rack, being operational to facilitate free slidable engagement of said movable jaw member within said channel from the closed state to the open state and from the open state to the closed state.

8. An adjustable wrench according to claim 7 wherein said means for manually disengaging said beam serrated toothed rack from said movable jaw member serrated toothed rack includes a first aperture in said handle central portion that is in communication with said void, wherein said first aperture is positioned substantially parallel lengthwise to the void longitudinal axis.

9. An adjustable wrench according to claim 8 wherein said beam includes an extension positioned substantially transverse to the beam longitudinal axis, said beam extension is sized and configured to slidably project therethrough said handle central portion first aperture, wherein said beam extension is operational to allow manual reciprocative movement of said beam within said void further allowing said beam serrated toothed rack to selectably matably engage with said movable jaw member serrated toothed rack and to selectably disengage said beam serrated toothed rack and said movable jaw member serrated toothed rack.

10. An adjustable wrench according to claim 1 wherein said handle second end portion includes an aperture that is operational to suspend said handle member from a support member, through the use of a suspension element.

11. An adjustable wrench according to claim 1 wherein said handle first end portion fixed jaw segment and said movable jaw member each include a fastener size indicia visibly disposed on each of said fixed jaw segment and said movable jaw member to identify relative jaw position corresponding to a fastener size.

12. An adjustable wrench according to claim 1 wherein said movable jaw member serrated toothed rack and said beam serrated toothed rack each have an acute angle formed between a serrated toothed rack step and a serrated toothed rack face.

13. An adjustable wrench for loosening or tightening a fastener, comprising:

(a) a handle member having a longitudinal axis between a handle first end portion, a handle central portion, and a handle second end portion, said first end portion including a fixed jaw segment, a fixed jaw surface plane, and a transverse axis to said fixed jaw surface plane, said first end portion also includes a channel therethrough positioned substantially parallel to said transverse axis, said central portion includes a void in communication with said channel, with said void having a longitudinal axis;

(b) a movable jaw member including a movable jaw segment, a movable jaw surface plane, and an engagement portion, said engagement portion is slidably engaged within said channel being operational to move said movable jaw member from an open state to a closed state and from the closed state to the open state, said movable jaw member also includes a serrated toothed rack whose pitch line forms an acute angle in relation to said movable jaw surface plane;

(c) a beam having a longitudinal axis, said beam is slidably engaged for reciprocative movement within said void, said beam including an end portion capable of projecting into said channel, said end portion having a serrated toothed rack that selectively matably engages with said movable jaw member serrated toothed rack, wherein said beam is operational to help secure said movable jaw member at a selected position between the closed state and the open state when said beam serrated toothed rack matably engages with said movable jaw member serrated toothed rack;

(d) a means for urging said beam serrated toothed rack to matably engage with said movable jaw member serrated toothed rack, wherein said means assists in urging said movable jaw member to a selected position moving from the open state to the closed state resulting in said movable jaw member in a secured position state upon the fastener against moving toward the open state, being operational to allow said adjustable wrench to loosen or tighten the fastener; and (e) a means for manually disengaging said beam serrated toothed rack from said movable jaw member serrated toothed rack, being operational to facilitate free slidable engagement of said movable jaw member within said channel from the open state to a closed state and from the closed state to the open state.

14. An adjustable wrench according to claim 13 further comprising a means for urging said movable jaw member toward the open state, being operational to allow said movable jaw member to move to the open state one by disengaging said beam serrated toothed rack from said movable jaw member serrated toothed rack.

15. An adjustable wrench according to claim 14 wherein said means for urging said movable jaw member into an open state is accomplished by a movable jaw member spring element.

16. An adjustable wrench according to claim 13 wherein said means for urging said beam serrated toothed rack to matably engage with said movable jaw member serrated toothed rack is accomplished by a beam spring element.

17. An adjustable wrench according to claim 13 wherein said means for manually disengaging said beam serrated toothed rack from said movable jaw member serrated toothed rack includes a first aperture in said handle central portion that is in communication with said void, wherein said first aperture is positioned substantially parallel lengthwise to the void longitudinal axis.

18. An adjustable wrench according to claim 17 wherein said beam includes an extension positioned substantially transverse to the beam longitudinal axis, said beam extension is sized and configured to slidably project therethrough said handle central portion first aperture, wherein said beam extension is operational to allow manual reciprocative movement of said beam within said void further allowing said beam serrated toothed rack to selectably matably engage with said movable jaw member serrated toothed rack and to selectably disengage said beam serrated toothed rack and said movable jaw member serrated toothed rack.

19. An adjustable wrench according to claim 13 further comprising a trigger member pivotally attached to said movable jaw member and slidably engaged to said handle member, wherein said trigger is operational to facilitate manual movement of said movable jaw member from the closed state to the open state and from the open state to the closed state when said beam serrated toothed rack is selectively disengaged from said movable jaw member serrated toothed rack.

20. An adjustable wrench according to claim 19 wherein said trigger includes an extension, a body with a slot, and a finger grip, said extension is pivotally attached to said movable jaw member and said slot is slidably engaged to said handle member, wherein said finger grip is operational to facilitate manual movement of said movable jaw member from the closed state to the open state and from the open state to the closed state.

21. An adjustable wrench according to claim 13 wherein said handle second end portion includes an aperture that is operational to suspend said handle member from a support member, through the use of a suspension element.

22. An adjustable wrench according to claim 13 wherein said handle first end portion fixed jaw segment and said movable jaw member each include a fastener size indicia visibly disposed on each of said fixed jaw segment and said movable jaw member to identify relative jaw position corresponding to a fastener size.

23. An adjustable wrench according to claim 13 wherein said movable jaw member serrated toothed rack and said beam serrated toothed rack each have an acute angle formed between a serrated toothed rack step and a serrated toothed rack face.

24. A method of using an adjustable wrench for loosening or tightening a fastener, comprising the steps of:

(a) providing an adjustable wrench assembly that includes a handle member with a fixed jaw segment, a movable jaw member with a serrated toothed rack, a beam with a serrated toothed rack, a means for urging said beam serrated toothed rack to matably engage with said movable jaw member serrated toothed rack, wherein said movable jaw member is assisted in urging toward a closed state and secured position state upon the fastener against moving toward the open state, a means for manually selectively disengaging said beam serrated toothed rack from said movable jaw member serrated toothed rack, and a trigger pivotally attached to said movable jaw member and slidably engaged to said handle member, said trigger member facilitating manual movement of said movable jaw member from the closed state to the open state and from the open state to the closed state when said beam serrated toothed rack is selectively disengaged from said movable jaw member toothed rack;

(b) grasping said handle member manually of said adjustable wrench assembly;

(c) moving and holding said means for manually selectively disengaging said beam serrated toothed rack from said movable jaw member serrated toothed rack;

(d) moving said trigger to selectively position said movable jaw member between the closed state and the open state;

(e) positioning said fixed jaw segment and said movable jaw member on the fastener;

(f) releasing said means for manually disengaging said beam serrated toothed rack from said movable jaw member serrated toothed rack, thus allowing said means for urging said beam serrated toothed rack to matably engage with said movable jaw member serrated toothed rack, wherein said movable jaw member is in a substantially secured position state upon the fastener; and (g) applying manual force to said handle member that is operational to loosen or tighten the fastener.

25. A method of using an adjustable wrench for loosening or tightening a fastener according to claim 24 wherein steps c, d, e, f, and g are sequentially repeated to provide for a ratcheting action of said adjustable wrench to loosen or tighten the fastener.

* * * * *